US011242783B1

(12) United States Patent
Chen

(10) Patent No.: US 11,242,783 B1
(45) Date of Patent: Feb. 8, 2022

(54) SOUND DEFLECTING MUFFLER

(71) Applicant: Terrance Chen, Cypress, CA (US)

(72) Inventor: Terrance Chen, Cypress, CA (US)

( * ) Notice: Subject to any disclaimer, the term of this patent is extended or adjusted under 35 U.S.C. 154(b) by 0 days.

(21) Appl. No.: 17/363,152

(22) Filed: Jun. 30, 2021

(51) Int. Cl.
*F01N 1/08* (2006.01)
*F01N 1/10* (2006.01)

(52) U.S. Cl.
CPC ..... *F01N 1/088* (2013.01); *F01N 1/10* (2013.01); *F01N 2240/20* (2013.01); *F01N 2310/02* (2013.01)

(58) Field of Classification Search
CPC . F01N 1/04; F01N 1/088; F01N 1/026; F01N 1/10; F01N 2310/02; F01N 2240/20; F01N 2490/16; F01N 2490/08
USPC ..... 181/264, 267
See application file for complete search history.

(56) References Cited

U.S. PATENT DOCUMENTS 2,122,086 A * 6/1938 Chase ..... F01N 1/089 181/269
2,512,155 A 6/1950 Hill
2,651,381 A 9/1953 Cooper
2,727,584 A * 12/1955 Marx ..... F01N 1/083 181/270
2,896,743 A * 7/1959 Bradshaw ..... B01D 45/08 55/308
3,567,403 A * 3/1971 Perga ..... B01D 53/944 422/179
5,304,749 A * 4/1994 Crandell ..... F01N 1/083 181/264
5,739,484 A * 4/1998 Jones ..... F01N 1/04 181/264
5,892,186 A * 4/1999 Flugger ..... F01N 1/10 181/252
5,936,210 A * 8/1999 Borneby ..... F01N 1/10 181/264
6,364,054 B1 4/2002 Bubulka et al.
7,549,512 B2 * 6/2009 Newberry ..... F01N 1/08 181/264
7,793,758 B2 * 9/2010 Rimback ..... F01N 1/083 181/282
8,083,026 B1 12/2011 Butler
8,640,822 B2 * 2/2014 Schooler ..... F01N 13/08 181/282
9,062,590 B2 * 6/2015 Schooler ..... F01N 13/00
9,488,079 B2 * 11/2016 Bartlett ..... F01N 13/1872
9,938,873 B2 * 4/2018 Bartlett ..... F01N 13/1872

* cited by examiner

*Primary Examiner* — Jeremy A Luks
(74) *Attorney, Agent, or Firm* — Dale J. Ream

(57) ABSTRACT

A sound deflecting muffler for deflecting and absorbing sound waves associated with exhaust gases of an internal combustion engine includes a casing having a muffler body defining an interior area and defining an inlet opening operatively connected to the internal combustion engine for receiving exhaust gases into the interior area and defining an outlet opening in communication with the interior area for directing the exhaust gases downstream from the interior area. The casing includes a pair of sound baffles that define a flow path for the exhaust gases flowing between the inlet and outlet of the muffler body, each sound baffle being perforated and having an arcuate configuration such that the flow path narrows at a midpoint. A first sound deflector is positioned in the flow path proximate the inlet end so as to deflect a portion of the exhaust gases toward the pair of sound baffles.

17 Claims, 3 Drawing Sheets

SOUND DEFLECTING MUFFLER

BACKGROUND OF THE INVENTION

This invention relates generally to automobile mufflers and, more particularly, to a muffler having a pair of spaced apart and opposed sound baffles each having an arcuate or curved configuration and being perforated for receiving a portion of exhaust gases streaming through the muffler body. Importantly, at least one sound deflector is positioned in the exhaust gas flow path and oriented to simultaneously deflect the exhaust gases toward the pair of sound baffles.

A muffler is a device for reducing the noise emitted by the exhaust of an internal combustion engine. More particularly, a muffler includes a casing having structures against which soundwave is associated with exhaust gases flowing there through may ricochet and be absorbed before remaining gases flow downstream from the muffler.

Various muffler designs have been proposed in the prior art and patent proposals for directing or redirecting a gaseous flow between an inlet opening and an outlet opening. Although presumably effective for their intended purposes, there is still a need for a muffler that deflects and incoming stream of exhaust gases more efficiently and quantitatively through a pair of sound baffles and onto sound absorbing material.

Therefore, it would be desirable to have a sound deflecting muffler having a pair of opposed sound baffles that are curved and perforated so as to increase the amount of an exhaust gas stream from a flow path and onto the sound absorbing fill material. Further, it would be desirable to have a sound deflecting muffler having at least one sound deflector positioned adjacent and inlet opening of the muffler casing having a shape configuration and being oriented to simultaneously direct a substantial portion of the exhaust gases toward the pair of sound baffles, respectively.

SUMMARY OF THE INVENTION

A sound deflecting muffler for deflecting and absorbing sound waves associated with exhaust gases of an internal combustion engine according to the present invention includes casing having a muffler body that defines an interior area. the muffler body has an inlet end defining an inlet opening operatively connected to the internal combustion engine for receiving exhaust gases therefrom into the interior area and has an outlet end defining an outlet opening in communication with the interior area for directing the exhaust gases downstream from the interior area. The casing includes a pair of spaced apart and opposed sound baffles that define a flow path for the exhaust gases flowing between the inlet end and the outlet end of the muffler body, each sound baffle being perforated and having an arcuate configuration such that a flow path narrows at a midpoint. A first sound deflector is positioned in the flow path of the casing proximate the inlet end so as to deflect the portion of the exhaust gases toward the pair of sound baffles.

Therefore, a general object of this invention is to provide a sound deflecting muffler for deflecting and absorbing sound waves associated with exhaust gases of an internal combustion engine.

Another object of this invention is to provide a sound deflecting muffler, as aforesaid, having a pair of spaced apart and opposed sound baffles each being perforated and having an arcuate work curved configuration for receiving sound waves associated with engine exhaust gases flowing between the pair of sound baffles.

Still another object of this invention is to provide a sound deflecting muffler, as aforesaid, in which said pair of sound baffles define chambers containing sound absorbing filler material.

Yet another object of this invention is to provide a sound deflecting muffler, as aforesaid, having at least one sound deflector positioned in the flow path and oriented so as to simultaneously deflect and inflow of sound producing exhaust gases toward the pair of curved sound baffles.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
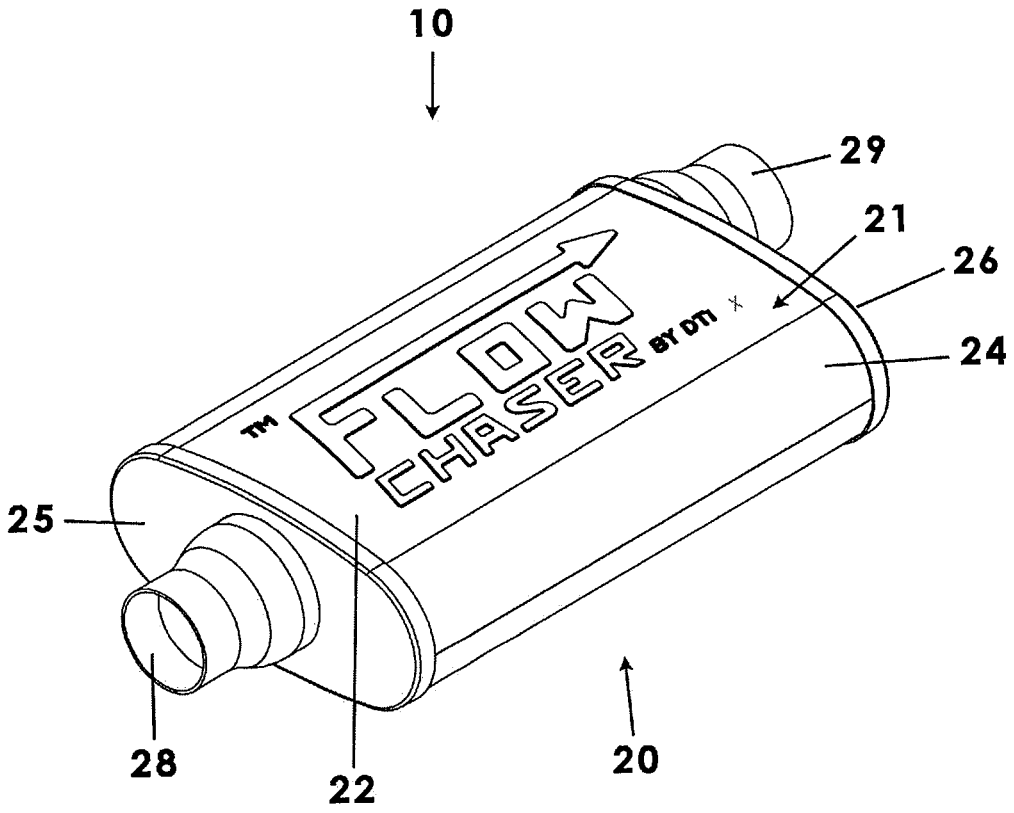
FIG. 1 is a perspective view of a sound deflecting muffler according to a preferred embodiment of the present invention.

A sound deflecting muffler according to a preferred embodiment of the present invention will now be described with reference to FIGS. 1 to 2*b* of the accompanying drawings. The sound deflecting muffler 10 includes a muffler casing 20 defining an interior area 36, a pair of perforated sound baffles 30 each having a curved configuration, at least a first sound deflector 40, and a quantity of sound absorbing material 46.

The muffler casing 20 (or, referred to simply as a casing) includes a muffler body 21 having multiple walls that may be manufactured or coupled together in a unitary construction. The muffler body 21 may have a top wall 22 and a bottom wall 23 opposite and generally spaced apart and opposite the top wall 22. In addition, the top and bottoms walls may be connected by side walls 24. The muffler body 21 may include an inlet end 25 and an outlet end 26 opposite the inlet end 25, the walls collectively defining an interior area 36 and generally enclosing the muffler body 21. Therefore, the muffler body 21 may have a generally rectangular cross-section although a cylindrical, oval, or other shape configuration is possible. Further, the inlet end 25 may define an inlet opening 28 and the outlet end 26 may define and outlet opening 27, the inlet and outlet openings including cylindrical or tubular structures that are open for fluid flow. It is understood that the inlet opening 28 is in communication with an exhaust system of an internal combustion engine of an automobile such that a stream of exhaust gases is able to flow downstream from the exhaust system and into the interior area 36 of the muffler casing 20. In other words, the inlet opening 28 is in fluid communication with the exhaust system of the automobile and also in fluid communication with the interior area 36 of the muffler body 21. Similarly, the outlet opening 27, located or defined by the outlet end 26, is in fluid communication with the interior area 36 such that exhaust gases may be directed away from the casing 20, such as into the ambient air behind the automobile. The outlet opening 27 may be offset from the inlet opening 28 (i.e., not aligned).

Further, the casing 20 may include a pair of sound baffles 30 that are spaced apart and opposed to one another and positioned in the interior area 36 of the muffler body 21, the pair of sound baffles 30 each including a proximal end 31 adjacent the inlet end 25 and a distal end 33 adjacent the outlet end 26 of the muffler body. In fact, the opposed ends of the pair of sound baffles 30 may actually be coupled to the inlet and outlet ends, respectively, such as by welding. Still further, the pair of sound baffles 30 may each include upper and lower edges that are coupled to the top wall 22 and bottom wall 23 of the muffler body 21, respectively. In addition, a pair of sound wave chambers 34 is defined between the pair of sound baffles 30 the sidewalls of the muffler body 21, respectively. The pair of sound baffles 30 act as a guide for the downstream flow of exhaust gases. Further, the pair of sound baffles 30 may include or otherwise define a plurality of holes so that respective soundwaves associated with at least a portion of the stream of exhaust gases may pass through and into respective soundwaves chambers 34. In an embodiment, the pair of sound baffles 30 may be a screen.

Figure 2A:
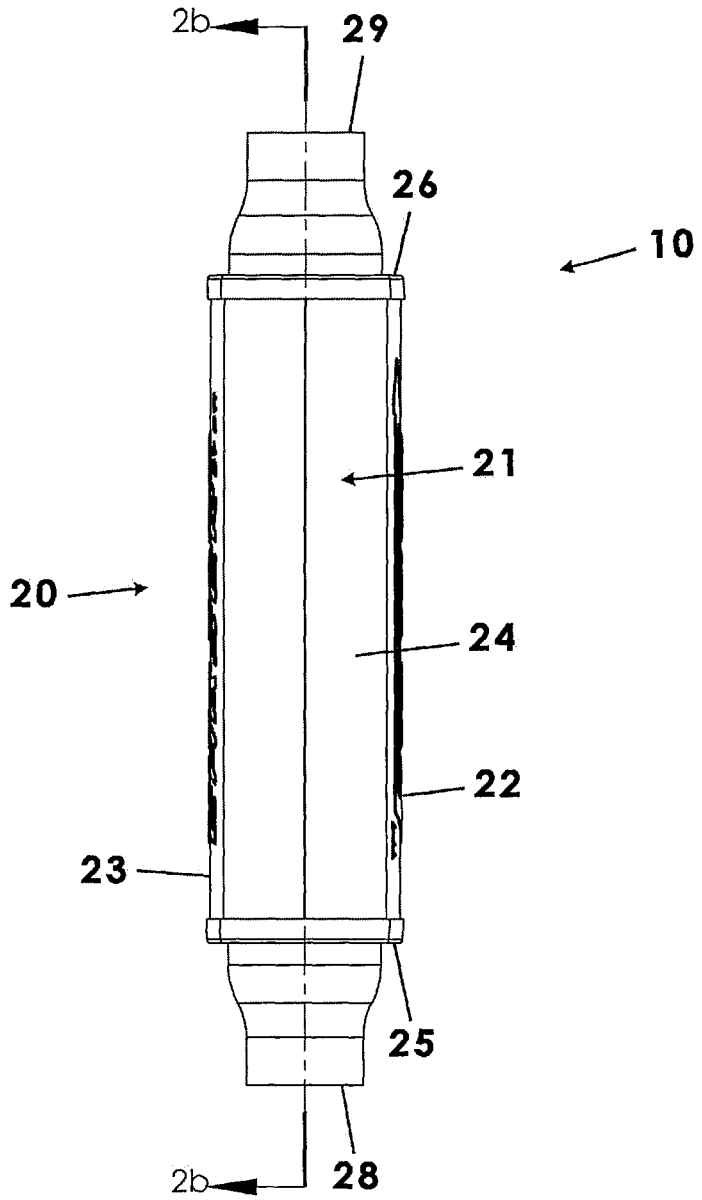
FIG. 2*a* is a side view of the sound deflecting muffler as in FIG. 1.
Figure 2B:
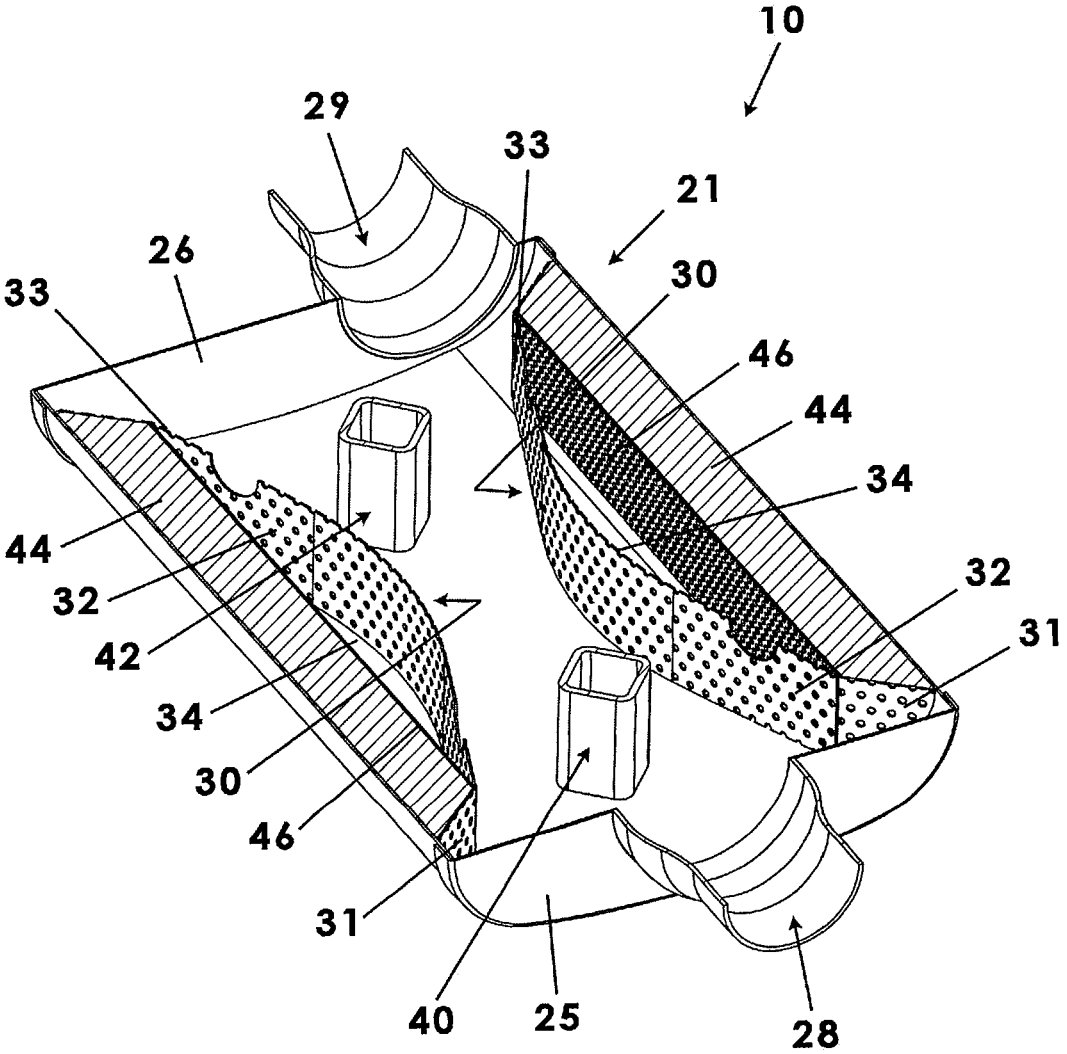
FIG. 2*b* is a sectional view taken along line 2*b*-2*b* of FIG. 2*a*.

In a critical aspect, the pair of sound baffles 30 have an arcuate configuration, i.e., a bow-like curvature that are maximally spaced apart proximate the inlet end 25, maximally extending toward one another at a midpoint between the inlet and outlet ends 25, 26 and then maximally spaced apart again proximate the outlet end 26 (FIG. 2). It will be understood that this curvature of the pair of sound baffles 30 enables a greater portion of the stream of exhaust gases to be directed to and through the pair of sound baffles 30 than if the pair of sound baffles 30 had a linear or some other configuration.

In another critical aspect, the sound deflecting muffler 10 may include at least a first sound deflector 40 that is mounted within the interior area 36 of the muffler body 21 near the inlet end 25 and configured to simultaneously direct the downstream flowing stream of exhaust gases toward the spaced apart pair of sound baffles 30. The first sound deflector 40 may include a 3D rectangular configuration (i.e., has a rectangular cross-section) and that is oriented such that an upstanding edge between two adjacent side walls is facing the inlet opening 28 and the adjacent side walls are angled toward the pair of sound baffles 30, respectively. In other words, the first sound deflector 40 has the appearance of being mounted in a diamond pattern such that the stream of exhaust gases is evenly and simultaneously bisected and directed toward the most spaced apart proximal ends 31 of the pair of sound baffles 30. Similarly, the sound deflecting muffler 10 may include a second sound deflector 42 that is mounted within the interior area 36 of the muffler body 21 near the outlet end 26 and configured to simultaneously direct the downstream-flowing stream of exhaust gases toward the spaced apart pair of sound baffles 30.

Each soundwave chamber 34 may include a quantity of sound-absorbing fill material 46. In embodiments, the sound-absorbing fill material 46 may include acoustic fiberglass, acoustic foam, acoustic cotton, acoustic glass mineral wool, or the like. The fill material is specifically engineered to absorb or at least dampen sound waves (i.e., engine noise) associated with the portion of exhaust gas that passes through the pair of sound baffles 30, respectively, into the pair of soundwave chambers 34. It will be understood that the sound absorbing fill material 46 may be held in place by a fill retaining screen 46 as is known in the art.

In use, the sound deflecting muffler 10 may be installed on a vehicle such as on an automobile, and the inlet opening 28 connected to the internal combustion engine thereof such that a stream of exhaust gases will flow in due course downstream through the interior area 36 of the muffler body 21. In an embodiment, the stream of exhaust gases is bisected by a first sound deflector 40 and a portion of the soundwaves associated with the exhaust gases is directed toward each of the pair of sound baffles 30. Preferably, the pair of sound baffles 30 each include a curved, a.k.a. and arcuate configuration and is perforated such that the more substantial portion of the soundwaves are directed toward and passed through the pair of sound baffles 30, respectively, and into respective sound absorbing chambers 34. The received soundwaves may be absorbed or dampened by the sound absorbing fill material 46. The remnant of exhaust gases continues to flow downstream within the flow path of the muffler body 21 where it may again be bisected and deflected toward the pair of sound baffles 30 and then exits through the outlet opening 27.

It is understood that while certain forms of this invention have been illustrated and described, it is not limited thereto except insofar as such limitations are included in the following claims and allowable functional equivalents thereof.

The invention claimed is:

1. A sound deflecting muffler for deflecting and absorbing sound waves associated with exhaust gases of an internal combustion engine, said sound deflecting muffler, comprising:

a casing having a muffler body that defines an interior area, said muffler body having an inlet end operatively connected to the internal combustion engine for receiving exhaust gases therefrom into said interior area and having an outlet end in communication with said interior area for directing said exhaust gases downstream from said interior area, said casing including a pair of spaced apart and opposed sound baffles that define a flow path for said exhaust gases flowing between said inlet end and said outlet end of said muffler body;

wherein said pair of sound baffles each has an arcuate configuration such that said flow path is incrementally narrowed between said inlet end to a midpoint between said inlet end and said outlet end and then said flow path is incrementally expanded between said midpoint and said outlet end;

wherein said pair of sound baffles defines a pair of soundwave chambers, respectively;

wherein said pair of sound baffles is perforated such that a portion of said exhaust gases pass through said pair of sound baffles into said pair of soundwave chambers, respectively;

a quantity of sound absorbing material positioned in said pair of soundwave chambers for dampening sound waves generated by said portion of said exhaust gases.

2. The sound deflecting muffler as in claim 1, further comprising a first sound deflector positioned in said flow path of said casing proximate said inlet end so as to deflect said portion of said exhaust gases toward said pair of sound baffles.

3. The sound deflecting muffler as in claim 2, wherein:

said muffler body includes a top wall and a bottom wall opposite and parallel to said top wall, said top and bottom walls defining said interior area;

said pair of sound baffles have proximal ends adjacent said inlet end, respectively, and distal ends adjacent said outlet end, respectively;

said pair of sound baffles include lower and upper edges coupled to inner surfaces of said bottom and top walls of said muffler body, respectively.

4. The sound deflecting muffler as in claim 3, wherein said first sound deflector has a rectangular cross-section and is oriented relative to said inlet end so as to simultaneously deflect said portion of said exhaust gases toward said pair of sound baffles.

5. The sound deflecting muffler as in claim 4, wherein:

said inlet end defines an inlet opening in fluid communication with the internal combustion engine and in fluid communication with said interior area for receiving the exhaust gases into said interior area; and said outlet end defines an outlet opening in fluid communication with said interior area for directing said exhaust gases downstream from said interior area.

6. The sound deflecting muffler as in claim 1, further comprising a pair of retainer screens positioned intermediate said pair of sound baffles and said quantity of sound absorbing material, respectively.

7. The sound deflecting muffler as in claim 2, further comprising a second sound deflector positioned in said flow path of said casing downstream from said first sound deflector so as to deflect another portion of said exhaust gases toward said pair of sound baffles.

8. The sound deflecting muffler as in claim 1, wherein said pair of sound baffles each include a screen.

9. The sound deflecting muffler as in claim 1, wherein said sound absorbing material is taken from a group comprising acoustic fiberglass, acoustic foam, acoustic cotton, and acoustic glass mineral wool.

10. A sound deflecting muffler for deflecting and absorbing sound waves associated with exhaust gases of an internal combustion engine, said sound deflecting muffler, comprising:

a casing having a muffler body that defines an interior area, said muffler body having an inlet end operatively connected to the internal combustion engine for receiving exhaust gases therefrom into said interior area and having an outlet end in communication with said interior area for directing said exhaust gases downstream from said interior area, said casing including a pair of spaced apart and opposed sound baffles that define a flow path for said exhaust gases flowing between said inlet end and said outlet end of said muffler body; said pair of sound baffles each has an arcuate configuration such that said flow path is incrementally narrowed between said inlet end to a midpoint between said inlet end and said outlet end and then said flow path is incrementally expanded between said midpoint and said outlet end; said pair of sound baffles defines a pair of soundwave chambers, respectively; said pair of sound baffles is perforated such that a portion of said exhaust gases pass through said pair of sound baffles into said pair of soundwave chambers, respectively a first sound deflector positioned in said flow path of said casing proximate said inlet end so as to deflect said portion of said exhaust gases toward said pair of sound baffles;

a quantity of sound absorbing material positioned in said pair of soundwave chambers for dampening sound waves generated by said portion of said exhaust gases.

11. The sound deflecting muffler as in claim 10, wherein:

said muffler body includes a top wall and a bottom wall opposite and parallel to said top wall, said top and bottom walls defining said interior area;

said pair of sound baffles have proximal ends adjacent said inlet end, respectively, and distal ends adjacent said outlet end, respectively;

said pair of sound baffles include lower and upper edges coupled to inner surfaces of said bottom and top walls of said muffler body, respectively.

12. The sound deflecting muffler as in claim 10, wherein said first sound deflector has a rectangular cross-section and is oriented relative to said inlet end so as to simultaneously deflect said portion of said exhaust gases toward said pair of sound baffles.

13. The sound deflecting muffler as in claim 10, wherein:

said inlet end defines an inlet opening in fluid communication with the internal combustion engine and in fluid communication with said interior area for receiving the exhaust gases into said interior area; and said outlet end defines an outlet opening in fluid communication with said interior area for directing said exhaust gases downstream from said interior area.

14. The sound deflecting muffler as in claim 10, further comprising a pair of retainer screens positioned intermediate said pair of sound baffles and said quantity of sound absorbing material, respectively.

15. The sound deflecting muffler as in claim 10, further comprising a second sound deflector positioned in said flow path of said casing downstream from said first sound deflector so as to deflect another portion of said exhaust gases toward said pair of sound baffles.

16. The sound deflecting muffler as in claim 10, wherein said pair of sound baffles each include a screen.

17. The sound deflecting muffler as in claim 10, wherein said sound absorbing material is taken from a group comprising acoustic fiberglass, acoustic foam, acoustic cotton, and acoustic glass mineral wool.

* * * * *